US008864004B2

(12) United States Patent
Crawford et al.

(10) Patent No.: US 8,864,004 B2
(45) Date of Patent: Oct. 21, 2014

(54) TOOL RETENTION DEVICE

(75) Inventors: Tom Crawford, Gig Harbor, WA (US); Tim Wegner, Gig Harbor, WA (US); Steve Avila, Edgewood, WA (US); Bryce Wegner, Puyallup, WA (US)

(73) Assignee: Blade-Tech Industries, Inc., Puyallup, WA (US)

( * ) Notice: Subject to any disclaimer, the term of this patent is extended or adjusted under 35 U.S.C. 154(b) by 221 days.

(21) Appl. No.: 12/970,722

(22) Filed: Dec. 16, 2010

(65) Prior Publication Data

US 2011/0147428 A1 Jun. 23, 2011

Related U.S. Application Data

(60) Provisional application No. 61/287,273, filed on Dec. 17, 2009.

(51) Int. Cl.

| | |
|---|---|
| ***A45F 4/00*** | (2006.01) |
| ***A45C 15/00*** | (2006.01) |
| ***A45C 1/04*** | (2006.01) |
| ***A45F 3/00*** | (2006.01) |
| ***F41C 33/02*** | (2006.01) |
| ***F42B 39/02*** | (2006.01) |
| ***B65D 33/14*** | (2006.01) |
| ***A45F 5/02*** | (2006.01) |
| ***A45C 11/24*** | (2006.01) |
| ***A45C 13/02*** | (2006.01) |

(52) U.S. Cl.

CPC ..... *A45C 13/02* (2013.01); *A45F 5/021* (2013.01); *A45C 11/24* (2013.01)

USPC ..... 224/584; 224/681; 224/682; 224/683; 224/684; 383/22

(58) Field of Classification Search

CPC ..... A45F 5/00; A45F 5/02; A45F 3/04

USPC ..... 224/584, 681–684; 383/22

See application file for complete search history.

(56) References Cited

U.S. PATENT DOCUMENTS

| | | | | |
|---|---|---|---|---|
| 2,576,231 | A | | 11/1951 | Lawson, Jr. et al. |
| 2,783,536 | A | | 3/1957 | McQueary |
| 3,168,971 | A | | 2/1965 | Goertzen |
| 3,717,188 | A | * | 2/1973 | Green ..... 224/42.11 |
| 4,408,706 | A | | 10/1983 | Hurley |
| 4,883,207 | A | * | 11/1989 | McArthur ..... 224/153 |
| 4,917,281 | A | | 4/1990 | Ostermiller |

(Continued)

OTHER PUBLICATIONS

Final Office Action, U.S. Appl. No. 12/970,728, (May 9, 2012), 7 pages.

(Continued)

*Primary Examiner* — Brian D Nash
*Assistant Examiner* — Derek Battisti
(74) *Attorney, Agent, or Firm* — Wolfe-SBMC

(57) ABSTRACT

A tool retention device is described. In implementations, a tool retention device may involve interchangeable panels that are used to retain tools. For example, an interchangeable panel has opposing first and second sides, where the first side includes tool retainers for retaining the tools. Additionally, a flexible bag component has an interior side that may removably secure the interchangeable panel. The flexible bag component also has an exterior side that may be removably secured to a user-wearable rig.

4 Claims, 3 Drawing Sheets

(56) References Cited

U.S. PATENT DOCUMENTS

| | | | | |
|---|---|---|---|---|
| 5,096,030 | A * | 3/1992 | Espinosa et al. | 190/108 |
| 5,248,072 | A | 9/1993 | Jones | |
| 5,501,382 | A | 3/1996 | Webb | |
| 6,102,266 | A | 8/2000 | Chacon et al. | |
| 6,193,125 | B1 | 2/2001 | Grover | |
| 6,655,529 | B2 * | 12/2003 | Ho | 206/373 |
| 6,715,594 | B2 * | 4/2004 | Milionta et al. | 190/110 |
| 7,490,358 | B1 * | 2/2009 | Beck | 2/2.5 |
| 8,011,484 | B2 * | 9/2011 | McIntyre | 190/110 |
| 2001/0008246 | A1 | 7/2001 | Grover | |
| 2002/0104768 | A1 * | 8/2002 | Nevarez | 206/315.11 |
| 2004/0140336 | A1 | 7/2004 | Estabaya | |
| 2005/0015944 | A1 * | 1/2005 | Bergeron | 24/584.1 |
| 2007/0158380 | A1 * | 7/2007 | Calkin | 224/675 |
| 2008/0257922 | A1 * | 10/2008 | Cragg | 224/269 |
| 2009/0277937 | A1 * | 11/2009 | Sabbag | 224/236 |
| 2011/0011904 | A1 | 1/2011 | Schultz et al. | |
| 2011/0072545 | A1 * | 3/2011 | Bennett | 2/2.5 |
| 2011/0147429 | A1 | 6/2011 | Crawford | |

OTHER PUBLICATIONS

Non-Final Office Action, U.S. Appl. No. 12/970,728, (Mar. 28, 2012), 5 pages.

Final Office Action, U.S. Appl. No. 12/970,728, Mar. 1, 2013, 8 pages.

Non-Final Office Action, U.S. Appl. No. 12/970,728, Oct. 10, 2012, 8 pages.

"Non-Final Office Action", U.S. Appl. No. 12/970,728, Apr. 8, 2014, 7 pages.

* cited by examiner

TOOL RETENTION DEVICE

RELATED APPLICATION

This application claims priority to U.S. Provisional Application Ser. No. 61/287,273 filed Dec. 17, 2009 entitled "Tool Retention Device" to Crawford et al., the disclosure of which is incorporated by reference herein in its entirety.

BACKGROUND

A variety of different tools may be employed by a user to perform a variety of different manual jobs, e.g., jobs performed by hand. For example, electricians, plumbers, construction workers and so on may utilize a variety of different tools to perform a variety of different tasks. Accordingly, these users may be confronted with carrying and organizing a multitude of different tools. However, traditional techniques that were used to carry the tools were inefficient, thereby resulting in a large amount of lost time by the user in fetching and tracking the various tools to perform the job.

SUMMARY

A tool retention device is described. In implementations, a tool retention device may involve interchangeable panels that are used to retain tools. For example, an interchangeable panel may have opposing first and second sides, where the first side includes tool retainers for retaining the tools. Additionally, a flexible bag component has an interior side that may removably secure the interchangeable panel. The flexible bag component also has an exterior side that may be removably secured to a user-wearable rig.

In implementations, a panel includes a plurality of sleeves in which tools may be retained. The sleeves may have opposing sides, at least one of which is configured to receive a tool via an opening. Additionally, a flexible member may be pivotally connected to the panel for pivotal movement. The flexible member may be configured for first and second configurations. The first configuration includes a secured position that is rolled to provide access to the sleeves, whereas the second configuration includes an unrolled position that is secured to restrict access to the tools via the opening of the sleeves. The flexible member is also pivotally connected to an extending member that is configured to extend a length of the flexible member.

In implementations, a tool retention device includes a flexible bag component that includes interior and exterior sides, and is mountable to a user wearable rig via one or more of the exterior sides. In addition, a panel is included that has opposing first and second sides. The first side may have a plurality of sleeves that are configured to retain one or more tools. Each of the sleeves may have an opening to receive the one or more tools. The second side may be configured to removably couple to an interior side of the flexible bag component. Additionally, the flexible bag component includes first and second configurations. The first configuration may include an open position that allows access to the one or more tools whereas the second configuration may include a closed position to restrict removal of the one or more tools.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different instances in the description and the figures may indicate similar or identical items.

DETAILED DESCRIPTION

Overview

Traditional techniques that were used to retain a wide variety of tools for different manual jobs are inefficient. For example, a large amount of lost time may result by the user fetching and tracking the various tools used to perform a job.

A tool retention device is described. In implementations, a panel with opposing sides includes a plurality of tool retainers on one side, whereas the other side is configured to removably couple to an interior side of a flexible bag component. The tool retainers may comprise sleeves with an end open to receive one or more tools. In addition, the flexible bag component is mountable to a user-wearable rig via an exterior side of the bag component and is configured to secure the panel to an interior side of the bag component. Further, the panel may be interchangeable with other panels with different configurations of tool retainers. By retaining and securing tools in this fashion, a user may spend less time fetching and tracking tools.

In the following discussion, an example environment is described that includes implementations of a tool retention device for retaining tools described herein. Example illustrations of the tool retention device are described, which may be employed in the example environment as well as in other environments. Accordingly, the example environment is not limited to performing the example techniques. Likewise, the example techniques are not limited to the implementations in the example environment.

Example Environment

Figure 1:
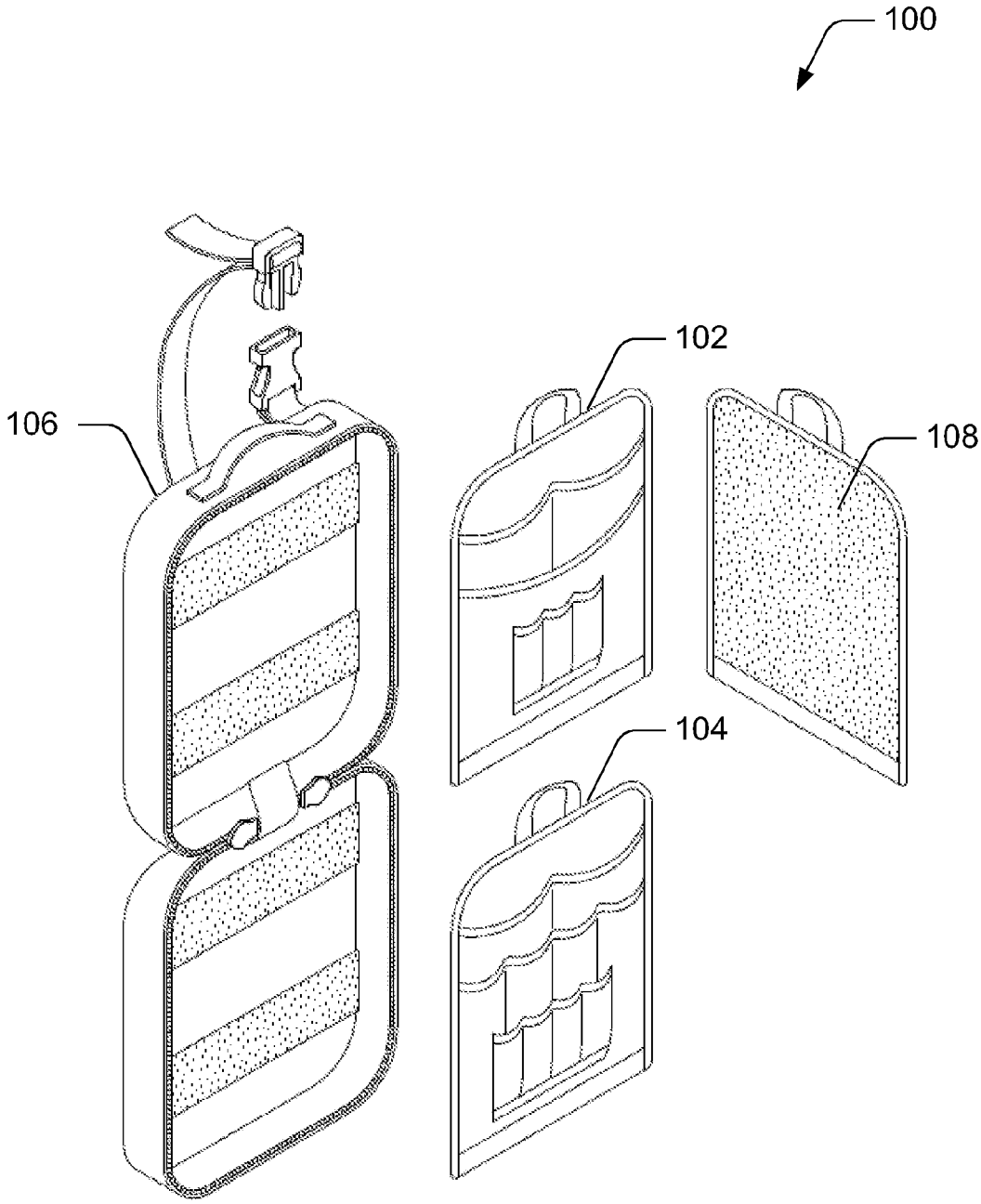
FIG. 1 is an illustration of an environment in an example implementation of a tool retention device in an open configuration for retaining tools described herein.

FIG. 1 is an illustration of an environment 100 in an example implementation that includes a tool retention device for retaining tools. The illustrated environment 100 includes one or more panels 102, 104 and a bag component 106. The panels 102, 104 may be removably affixed to one or more interior sides of the bag component 106. Additionally, the panels 102, 104 may be interchangeable with one another and/or other panels.

One or more of the panels 102, 104 may have opposing sides. For example, panel 102 is illustrated as having opposing first and second sides 102 and 108, respectively. The first side 102 may include a plurality of tool retainers configured to retain a variety of different tools. For example, the tool retainers may include loops, hook and loop (e.g., VELCRO), elastic, sleeves, pockets, and so on. The plurality of tool retainers may also include any combination of different types of tool retainers. Some examples of tools that may be retained by the tool retainers may include, but are not limited to, electric hand tools (e.g., cordless screwdrivers, flashlights, multimeters, voltage meter), non-power hand tools (e.g., wrenches, screwdriver, pliers, knives, tape measures), electrical tools (e.g., splice connecters, tape), and so on. Other examples may include tools for plumbing or construction.

In addition, different panels may include different configurations of tool retainers for retaining various types of tools. For example, each interchangeable panel may be configured to include tools for a specific job. Indeed, a variety of different configurations of tool retainers are contemplated to provide a user with a variety of options for retaining different tools. For example, panel 102 illustrates an arrangement including tool retainers in the form of pockets with an opening at one end to receive one or more tools. The example arrangement includes two tool retainers disposed proximate to one another and each having a side proximate to an outer edge of the panel 102. The arrangement also includes additional tool retainers each having two opposing sides proximate to the outer edges of the panel 102, and one of the additional tool retainers overlapping the other. In addition, the arrangement includes three small tool retainers that are smaller in size than the other tool retainers included on the panel 102 and which are disposed proximate to one another. The small tool retainers, in this example, are disposed in a configuration that is parallel to the other tool retainers included on the panel 102.

A different configuration of tool retainers is illustrated by example panel 104, which includes two tool retainers disposed proximate to one another and each having a side proximate to an outer edge of the panel 104. The panel 104 also includes two sets of four tool retainers, each tool retainer in each respective set disposed proximate and parallel to one another. The tool retainers described in these examples may also differ in size (e.g., length or width). These configurations illustrated by the panels 102 and 104 are merely examples and are not intended to be limiting configurations of tool retainers. Other configurations of tool retainers are also contemplated. For example, another example configuration may include eight assorted pockets and five small tool or bit pockets. Yet another example configuration may include four assorted pockets, two toll pockets, two pockets for bulky items, and three The second side 108 of the panel 102 may be configured to be removably coupled to an interior side of the bag component 106. Any suitable method of coupling may be used. For example, fasteners used may include hook and loop (e.g., VELCRO), loops, elastic, clips, snaps, and so on. The panel 102 may then be removed from the bag component 106 and replaced with a different panel, such as panel 104, configured to retain different tools.

In addition, an edge of the panel 102 that is proximate to the open ends of the tool retainers may include a component, such as a loop, hook, clip, and so on, that is configured to support the panel 102 in a hanging position. For example, a user may wish to remove the panel 102 from the bag component 106 and hang the panel 102 on a hook for storage purposes while coupling a different panel to the bag component 106. This may enable the user to quickly and conveniently prepare to carry a different set of tools without having to remove and replace tools from the tool retainers one at a time.

In addition, the panels 102, 104 may be formed from a variety of different substances, such as a puncture resistant nylon with a rubber lining to help retain tools within the tool retainers and provide protection from the elements and foreign objects, e.g., dust. Additionally, the substance may be lightweight to reduce the load when being carried by the user. The substance may also be flexible, rigid, or a combination thereof.

The bag component 106 may be configured to house one or more of the panels 102, 104 in a secured position. The environment 100 illustrates the bag component 106 in an open configuration in which the panels 102 and 104 may be coupled to the interior sides of the bag component 106. This allows access to tools stored in the tool retainers on the panels 102, 104. The bag component 106 may also include two or more members pivotally connected along corresponding confronting ends to allow the bag component 106 to open and close in a pivotal movement.

Figure 2:
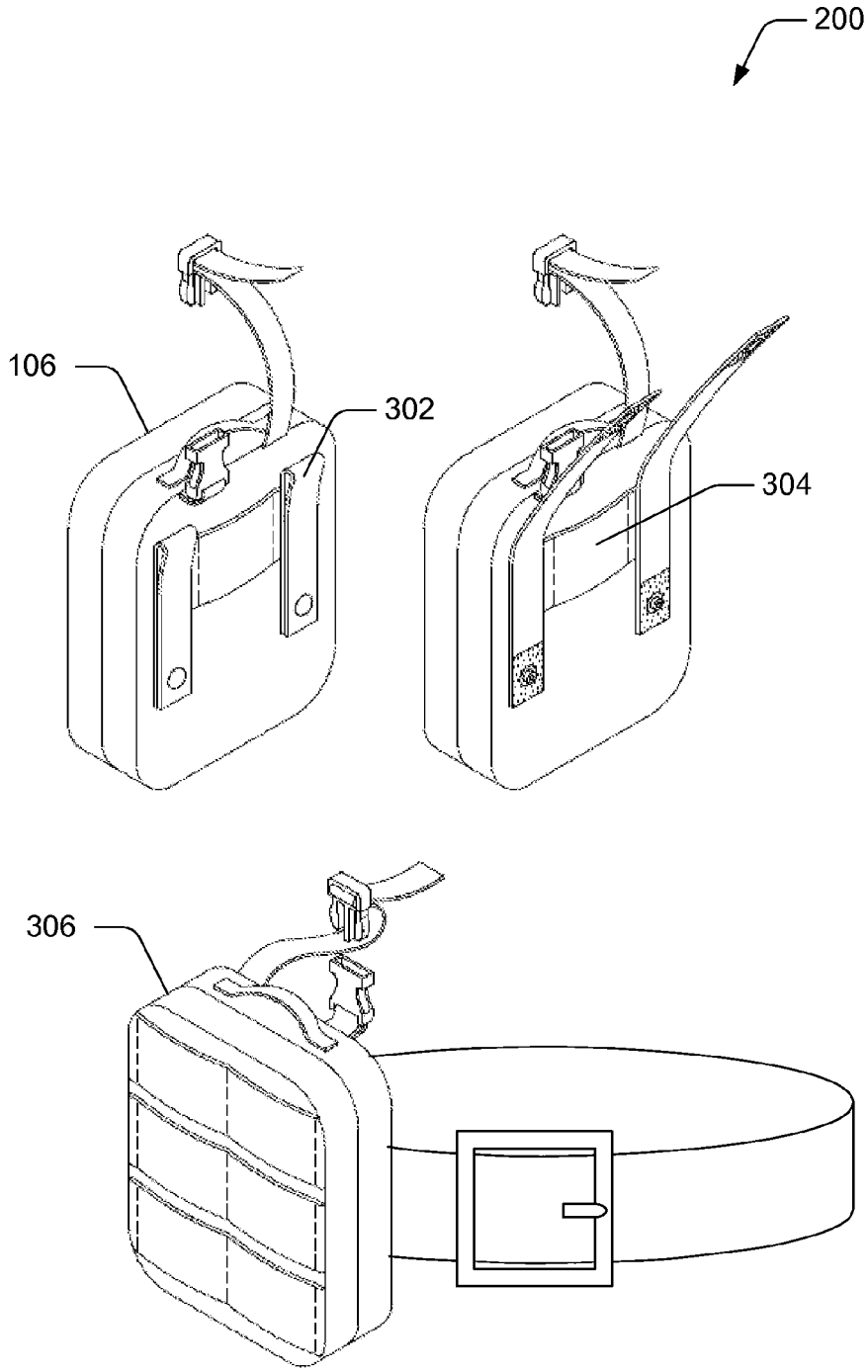
FIG. 2 is an illustration of an environment in an example implementation of a tool retention device in a closed configuration for retaining tools described herein.

Having considered the open configuration of the bag component in FIG. 1, consider now a closed configuration of the bag component as shown in FIG. 2, which is illustrated in an example environment 200 of a tool retention device. In this example environment 200, the closed configuration may be secured by fastening together lateral side edges of the bag component 106. Any suitable fastener may be used including, but not limited to, a zipper, clip, snap, hook and loop, hook, and so on. Securing the bag component 106 in a closed configuration may limit access to tools stored in the tool retainers on the panels and also may reduce and even prevent loss of tools from the tool retainers.

Additionally, the bag component 106 may be mountable to an apparatus wearable by a user. By way of example and not limitation, the apparatus may include a Modular Lightweight Load-bearing Equipment (MOLLE) rig, or any other suitable rig wearable by a user. The rig may be configured as a chest rig, shoulder rig, thigh rig, tool belt, backpack, and so on. In this way, the user may be provided with a variety of different options to affix and carry the panels.

For example, the different options may include various locations relative to the user's body, such as the user's thigh level, hip level, waist level, rib level, chest level, back, and so on. Accordingly, the user may affix and carry multiple panels in a variety of mountable positions that are customizable for and by the user. The bag component 106 may be mountable to the rig via one or more of the exterior sides of the bag component 106 to enable the user to access the tools without disconnecting the bag component from the rig. For example, the environment 200 illustrates one or more straps 302 configured to loop around a component of the rig and fasten each end of the straps together. For example, the one or more straps 302 may loop around a belt or other horizontal component of the rig. Additionally, the environment 200 illustrates a strap 304 that may be formed as a sleeve and open at both opposing ends to allow a rig component to slide through the sleeve. Other mountable configurations are also contemplated.

In implementations, the bag component 106 may include a handle 306 configured to allow a user to carry the bag component 106 by hand. The handle 306 may also be used to mount the bag component 106 to the user wearable rig. Additionally, a strap with a clip or other fastener may be disposed proximate to the handle to allow a user to hang the bag component 106 from a different object such as, for example, a ladder rung, a bar, a rail, a post, and so on. In addition, at least one exterior side of the bag component 106 may include MOLLE-type attachment loops. These attachment loops may be used to attach smaller bags and/or accessories.

To enable the user to affix and carry the tool retention device, a range of sizes is contemplated so as to not overburden the user. The bag component may be formed within a range of 5"×5" to 9"×12.5". One example size for the bag component may include 7.5"×8.5"×3.5". Another example bag component size may include 8"×11.5"×3.5". The panels may be suitably sized so as to fit inside the bag component and may include a range of sizes from 4"×4" to 8.5"×12". For example, a 7"×8" panel may suitably secure to the interior side of a 7.5"×8.5"×3.5" bag component. Another example sized panel may include a 7.5"×11" panel to secure to the interior side of a 8"×11.5"×3.5" bag component.

Figure 3:
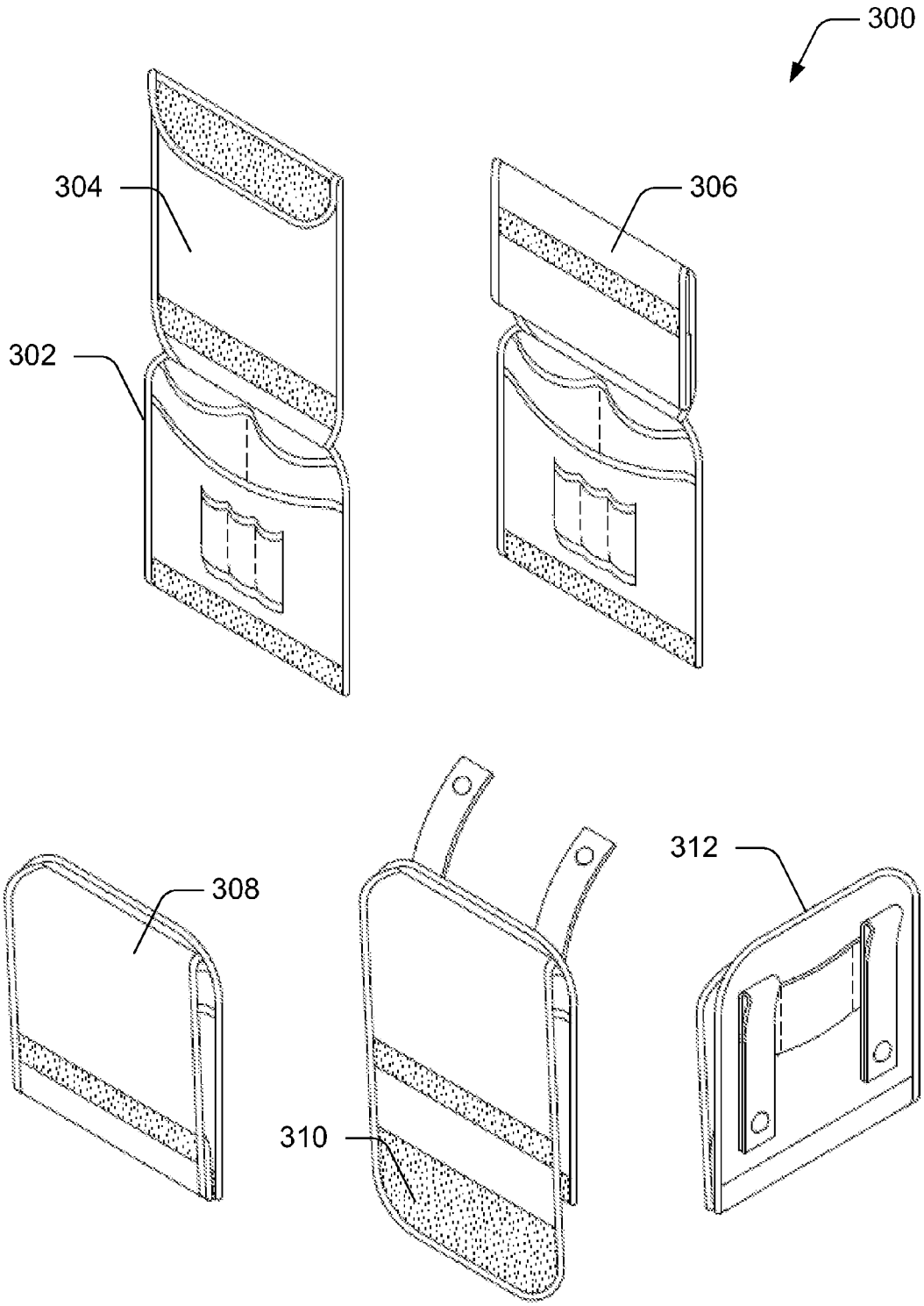
FIG. 3 is an illustration of an example implementation of a tool retention device in a variety of configurations for retaining tools described herein.

Having considered the bag component 106 which is configured to house the one or more panels 102 and 104, consider now FIG. 3, which illustrates an additional configuration of the tool retention device. FIG. 3 is an illustration of an environment 300 in an example implementation of a tool retention device. The illustrated environment 300 includes a panel 302 with one side comprising one or more tool retainers. Different panels may include different arrangements of tool retainers as well as different sizes of tool retainers. The illustrated environment 300 also includes a member 304 that is pivotally connected to the panel 302 for pivotal movement of the member 304. For example, the member 304 may include a flap or cover configured to cover the tools in the tool retainers.

In implementations, the member 304 may be flexible so as to be rolled up and secured in a rolled position 306, or unrolled and secured in an unrolled position 308. The rolled position 306 may be configured to enable access to the tool retainers and tools retained therein. On the other hand, the unrolled position 308 may be configured to restrict access to and restrict removal of the tools in the tool retainers. The member 304 may be disposed proximally to the opening of the tool retainers so that in the unrolled position 308 the tools are restricted from removal from the tool retainers. However, the member 304 may be pivotally connected to a variety of suitable locations on the panel 302. For example, the member may be pivotally connected to the panel in a manner parallel to one or more of the tool retainers, or alternatively, proximal to a side of the panel that opposes the opening of the tool retainers.

The member 304 may include one or more fasteners to secure the member 304 in either the rolled position 306 or the unrolled position 308. For example, the member 304 may comprise a flap that can reverse over and attach to itself to allow access to the tools in the tool retainers without the user having to hold the flap open. In addition, the flap may reverse over and attach to itself to hang from an object such as a ladder, scaffolding, railing, and so on as previously described. By way of example and not limitation, the one or more fasteners may include VELCRO, snaps, hooks, clips, loops, and so on.

In the unrolled position 308, the member 304 may be secured to the panel 302 along an edge of the panel 302 that is opposite to the pivotal connection of the member 304 to the panel 302. In this example, VELCRO is illustrated along the bottom edge of the panel 302 and along the outer edge of the member 304. The unrolled position 308 can thereby be secured by connecting the outer edge of the member 304 to the bottom edge of the panel 302.

The member 304 may also be connected to an extending member 310 which is configured to extend a length of the member 304. This may be beneficial when bulky tools are stored in the tool retainers, which may limit a portion of the outer edge of the member 304 from reaching the bottom edge of the panel 302 that is sufficient to secure member 304. The extending member 310 may include a fastener configured to fasten to the bottom edge of the panel 302 to secure the member 304 in the unrolled position and restrict removal of the bulky tools. In addition, the extending member 310 may be configured to affix to the member 304 when the outer edge of the member 304 is sufficient to secure the member 304 in the unrolled position.

The panel 302 may also be mountable to the apparatus worn by the user. For example, a side 312 of the panel that opposes the side with the tool retainers may include one or more straps configured to loop around a belt or a MOLLE-type attachment loop on a user-wearable apparatus. These straps may be configured to attach each end of the straps together to allow for a secured mount. In implementations, the panel may include a strap formed as a sleeve open at both opposing ends to allow an object to slide through and support the panel in a hanging position.

A panel's size may determine the size and/or weight of the tools being carried by the user. Thus, a variety of panel sizes is contemplated which may be tailored to a user's carrying capacity and/or the types of tools to be carried. An example range of suitable sizes of the panel 302 includes a range from 5"×5" to 9"×12.5". For example, the panel 302 may include a small size 6"×6.5", a medium size 7.5"×8.5", or a large size 8"×11.5". These sizes are merely examples and are not intended to be limiting. Also, the extending member 310 may be formed in a variety of different lengths within an example range of 1" to 4". One example includes an extending member 310 that provides a 2" extension to the member 304 to allow for bulky or long tools to be retained in the tool retainers.

Conclusion

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

What is claimed is:

1. An apparatus comprising:

a panel comprising a plurality of sleeves configured to retain one or more tools, one or more of the plurality of sleeves comprising opposing sides at least one of which is configured to receive the one or more tools via an opening;

a flexible member pivotally connected to the panel for pivotal movement of the flexible member, the flexible member configured for first and second configurations, the first configuration including a secured position that is rolled to provide access to the plurality of sleeves, the first configuration being secured by fastening together fastening components coupled to the flexible member in a rolled position that is proximate to the opening of the at least one of the opposing sides of the plurality of sleeves, the fastening components disposed on each of opposing first and second sides of the flexible member and configured to fasten together to secure the first side to the second side when the flexible member is in the rolled position, the second configuration including an unrolled position that is secured to restrict access to the one or more tools through the opening of the one of the opposing sides; and an extending member pivotally connected to the flexible member to extend a length of the flexible member, the extending member having additional fastening components that are disposed on both opposing sides of the extending member and which are configured to secure the extending member to the panel in the second configuration with the extended length of the flexible member and secure the extending member to the panel in the second configuration without the extended length of the flexible member.

2. The apparatus of claim 1, wherein the flexible member is disposed proximally to the opening of the one or more of the plurality of sleeves.

3. The apparatus of claim 1, wherein the second configuration is configured to secure the flexible member via the extending member.

4. The apparatus of claim 1, wherein the first configuration is secured to allow removal of the one or more tools through the opening of the one or more of the plurality of sleeves.

* * * * *